US008770235B2

(12) United States Patent
Wahhoud et al.

(10) Patent No.: US 8,770,235 B2
(45) Date of Patent: Jul. 8, 2014

(54) REED AND WEAVING MACHINE FOR WEAVING PATTERN FORMATION IN WOVEN FABRICS WITH ADDITIONAL PATTERN EFFECTS

(75) Inventors: Adnan Wahhoud, Lindau (DE); Peter Czura, Wangen (DE); Harald Arnold, Kisslegg (DE)

(73) Assignee: Lindauer DORNIER Gesellschaft mbH, Lindau (DE)

( * ) Notice: Subject to any disclaimer, the term of this patent is extended or adjusted under 35 U.S.C. 154(b) by 5 days.

(21) Appl. No.: 13/817,850

(22) PCT Filed: Aug. 8, 2011

(86) PCT No.: PCT/EP2011/063594

§ 371 (c)(1), (2), (4) Date: Feb. 20, 2013

(87) PCT Pub. No.: WO2012/022641

PCT Pub. Date: Feb. 23, 2012

(65) Prior Publication Data

US 2013/0153080 A1 Jun. 20, 2013

(30) Foreign Application Priority Data

Aug. 20, 2010 (DE) ..... 10 2010 034 969

(51) Int. Cl.

| | |
|---|---|
| ***D03D 49/62*** | (2006.01) |
| ***D03D 49/68*** | (2006.01) |
| *D03D 49/60* | (2006.01) |
| *D03D 47/26* | (2006.01) |

(52) U.S. Cl.

CPC ..... *D03D 49/68* (2013.01); *D03D 49/62* (2013.01); *D03D 47/263* (2013.01)

USPC ..... 139/192; 139/188 R; 139/191

(58) Field of Classification Search

CPC ..... D03D 49/62; D03D 47/263; D03D 49/68

USPC ..... 139/192, 50, 191, 11, 188 R, 435.6, 48, 139/1 E, 1 R, 46

See application file for complete search history.

(56) References Cited

U.S. PATENT DOCUMENTS

| | | | | |
|---|---|---|---|---|
| 566,551 | A | 8/1896 | Veyron | 139/49 |
| 1,567,820 | A * | 12/1925 | Stimpson | 139/188 R |

(Continued)

FOREIGN PATENT DOCUMENTS

| | | |
|---|---|---|
| DE | 102010007048 | 8/2011 |
| EP | 0 263 392 | 4/1988 |

(Continued)

OTHER PUBLICATIONS

PCT, International Search Report of the International Searching Authority for International Application PCT/EP2011/063594, mailed Oct. 18, 2012, 2 pages, European Patent Office, HV Rijswijk, Netherlands.

(Continued)

*Primary Examiner* — Bobby Muromoto, Jr.
(74) *Attorney, Agent, or Firm* — W. F. Fasse

(57) ABSTRACT

For producing woven fabrics with additional pattern effects, one or more effect threads are supplied substantially in the warp direction and are moved over neighboring warp threads in the weft direction, above a weft thread that is to be inserted, in various motion cycles of a weaving machine. Subsequently the effect threads are positioned below a subsequent weft thread, by submerging the effect threads into upwardly open reed gaps of a reed. To facilitate this, the reed includes first reed blades which, at their upper end, each include a sloping thread guide element projecting in the longitudinal direction of the reed, so as to at least partially extend over the upwardly facing opening of a neighboring reed gap. The reed further includes second reed blades having no such sloping thread guide elements. The guide elements guide the effect threads down into the proper reed gaps.

21 Claims, 2 Drawing Sheets

(56) References Cited

U.S. PATENT DOCUMENTS

Figure 2:
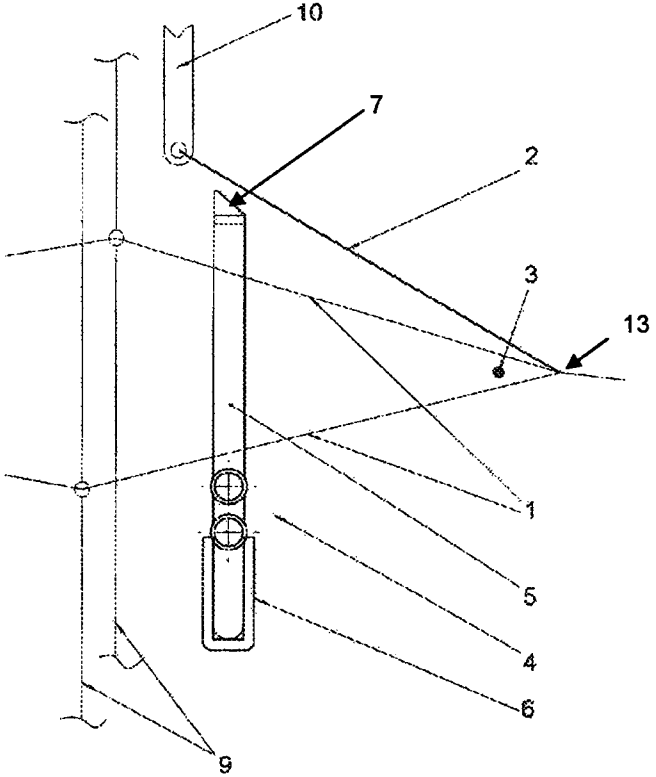

| | | | | | |
|---|---|---|---|---|---|
| 1,609,272 | A | * | 11/1926 | Davis | 139/2 |
| 2,572,365 | A | * | 10/1951 | McFetters | 139/192 |
| 3,379,223 | A | * | 4/1968 | Heinrich | 139/436 |
| 3,463,199 | A | * | 8/1969 | Crenshaw et al. | 139/54 |
| 3,552,691 | A | | 1/1971 | Haller | 245/10 |
| 3,634,827 | A | | 1/1972 | Lourie et al. | 700/131 |
| 3,728,680 | A | | 4/1973 | Upshur | 340/679 |
| 3,744,035 | A | | 7/1973 | Geirhos et al. | 700/131 |
| 3,882,903 | A | * | 5/1975 | Deborde | 139/192 |
| 4,016,911 | A | | 4/1977 | Looker | 139/383 R |
| 4,155,378 | A | * | 5/1979 | Senn | 139/1 R |
| 4,406,312 | A | | 9/1983 | Egbers et al. | 139/453 |
| 4,429,722 | A | * | 2/1984 | Herzog | 139/48 |
| 4,529,014 | A | * | 7/1985 | Rast et al. | 139/435.6 |
| 4,605,044 | A | | 8/1986 | Sakano | 139/304 |
| 4,716,943 | A | | 1/1988 | Yoshida et al. | 139/452 |
| 4,721,135 | A | * | 1/1988 | Tsubata et al. | 139/46 |
| 4,787,422 | A | * | 11/1988 | Peter et al. | 139/435.6 |
| 5,056,566 | A | | 10/1991 | Salomez | 139/452 |
| 5,058,628 | A | | 10/1991 | Spiller et al. | 139/25 |
| 5,066,535 | A | | 11/1991 | Christie | 428/196 |
| 5,069,257 | A | | 12/1991 | Borisch | 139/99 |
| 5,390,709 | A | | 2/1995 | Martonffy | 139/458 |
| 5,412,578 | A | | 5/1995 | Takagi et al. | 700/192 |
| 5,568,826 | A | | 10/1996 | Vogel et al. | 139/25 |
| 5,582,213 | A | | 12/1996 | Okawa | 139/46 |
| 5,669,421 | A | | 9/1997 | Lehnert et al. | 139/1 R |
| 5,794,665 | A | | 8/1998 | Keim | 139/455 |
| 5,829,487 | A | | 11/1998 | Thomas et al. | 139/319 |
| 6,145,551 | A | | 11/2000 | Jayaraman et al. | 139/387 R |
| 6,220,309 | B1 | | 4/2001 | Sollars, Jr. | 139/389 |
| 6,257,283 | B1 | * | 7/2001 | Lenzi | 139/50 |
| 6,467,512 | B1 | | 10/2002 | Meyer et al. | 139/435.2 |
| 6,595,244 | B1 | | 7/2003 | Sollars, Jr. | 139/389 |
| 6,650,779 | B2 | | 11/2003 | Vachtesvanos et al. | 382/228 |
| 6,659,139 | B2 | | 12/2003 | Laycock et al. | 139/422 |
| 6,876,162 | B2 | | 4/2005 | Bilcke | 318/34 |
| 6,904,942 | B2 | | 6/2005 | Odenthal | 139/383 A |
| 6,907,310 | B2 | | 6/2005 | Gardner et al. | 700/132 |
| 6,957,671 | B2 | | 10/2005 | Pannekoucke et al. | 139/50 |
| 6,978,808 | B2 | | 12/2005 | Walsh et al. | 139/11 |
| 6,994,120 | B2 | | 2/2006 | Speich | 139/1 R |
| 7,409,970 | B2 | | 8/2008 | Sollars, Jr. | 139/389 |
| 7,438,092 | B2 | * | 10/2008 | Wahhoud | 139/50 |
| 7,513,276 | B2 | | 4/2009 | Westerkamp | 139/383 A |
| 8,136,555 | B1 | | 3/2012 | Chang et al. | 139/384 R |
| 2001/0039974 | A1 | | 11/2001 | Wahhoud et al. | 139/25 |
| 2003/0064646 | A1 | | 4/2003 | Brown et al. | 442/189 |
| 2003/0066569 | A1 | | 4/2003 | Wahhoud | 139/110 |
| 2003/0070721 | A1 | | 4/2003 | Wahhoud | 139/435.1 |
| 2003/0136459 | A1 | | 7/2003 | Laycock et al. | 139/421 |
| 2003/0178087 | A1 | | 9/2003 | Odenthal | 139/383 A |
| 2004/0065380 | A1 | | 4/2004 | Speich | 139/383 R |
| 2004/0094223 | A1 | | 5/2004 | Johnson et al. | 139/383 A |
| 2005/0011578 | A1 | | 1/2005 | Walsh et al. | 139/383 R |
| 2006/0249933 | A1 | | 11/2006 | Sollars, Jr. | 280/729 |
| 2006/0281382 | A1 | | 12/2006 | Karayianni et al. | 442/181 |
| 2007/0028992 | A1 | | 2/2007 | Westerkamp | 139/383 A |
| 2007/0295423 | A1 | * | 12/2007 | Wahhoud | 139/52 |
| 2008/0169040 | A1 | | 7/2008 | Barrett | 139/383 A |
| 2008/0228312 | A1 | | 9/2008 | Dickerson | 700/132 |
| 2009/0035537 | A1 | | 2/2009 | Hack-Ueberall et al. | 428/196 |
| 2009/0053288 | A1 | | 2/2009 | Eskridge et al. | 424/447 |
| 2009/0191777 | A1 | | 7/2009 | Liao | 442/164 |
| 2010/0032120 | A1 | | 2/2010 | Ringer et al. | 162/358.2 |
| 2010/0139540 | A1 | | 6/2010 | Cronburg et al. | 114/102.29 |
| 2011/0030909 | A1 | | 2/2011 | Danby et al. | 162/358.2 |
| 2011/0114278 | A1 | | 5/2011 | Stone et al. | 162/289 |
| 2011/0130860 | A1 | | 6/2011 | Kelley | 700/121 |
| 2012/0102615 | A1 | | 5/2012 | Dickerson | 2/69 |
| 2012/0178330 | A1 | | 7/2012 | Stone | 442/295 |
| 2012/0244772 | A1 | | 9/2012 | Elder | 442/203 |
| 2013/0105029 | A1 | * | 5/2013 | Hannes et al. | 139/11 |
| 2013/0340881 | A1 | | 12/2013 | Boegl at al. | 139/55.1 |

FOREIGN PATENT DOCUMENTS

| | | |
|---|---|---|
| EP | 1 849 897 | 4/1988 |
| EP | 0 957 191 | 11/1999 |
| WO | WO 2007/093504 | 8/2007 |

OTHER PUBLICATIONS

PCT, PCT Written Opinion of the International Searching Authority for International Application PCT/EP2011/063594, mailed Oct. 18, 2012, 5 pages, International Bureau of WIPO, Geneva, Switzerland.

* cited by examiner

REED AND WEAVING MACHINE FOR WEAVING PATTERN FORMATION IN WOVEN FABRICS WITH ADDITIONAL PATTERN EFFECTS

FIELD OF THE INVENTION

The present invention relates to a reed and a weaving machine for weaving pattern formation in woven fabrics with additional pattern effects.

BACKGROUND INFORMATION

In weaving machines it is known in the prior art to involve additional threads, which essentially extend in the warp direction, in the woven fabric weave or interlacing in such a manner, so that certain additional pattern effects are achieved. For this purpose, these effect threads are brought into a prescribed position in the weft direction before the insertion of a weft thread for each motion cycle of the weaving machine.

A weaving machine with which such additional pattern effects are produced, includes at least one guide means for one or more effect thread, which is connected with a sliding displacement device. Thereby, the effect threads together with the guide means are slidingly displaceable in the weft direction by a sliding displacement path or distance prescribed by a weaving pattern. Furthermore, devices for weaving pattern dependent vertical movement of the guide means are provided on such a weaving machine, as well as a reed device for the beating-up of a weft thread against a woven fabric edge by means of a beat-up motion. Such a device is shown for example by EP 0 957 191. With regard to woven fabrics of this kind, one also refers to additional weft effects, because the additional pattern effect primarily consists in that the effect threads, which extend essentially in the warp direction, are slidingly displaced and bound in the weft direction compared with the ground warp threads.

In the prior art, reeds with reed blades or dents are also known, which form one-sided upwardly open reed gaps in such a way, that effect threads, which extend essentially in the warp direction, can immerse or submerge into and again emerge out of these reed gaps with a vertical movement. Such a reed is shown for example by EP 263 392. In this apparatus, however, all of the threads that extend in the warp direction, namely ground warp threads and effect threads, emerge out of and again submerge into the reed gaps, during the beat-up motion of the reed.

During the submerging of an effect thread into an open reed gap, problems can arise especially with coarser yarn, because the effect thread can get stuck on one of the reed blades or dents which bound this reed gap.

SUMMARY OF THE INVENTION

It is an object of embodiments of the present invention to provide a reed for a weaving machine, wherein in the formation of additional pattern effects the immersion or submerging of effect threads into the upwardly open reed gaps of a reed runs smoothly.

In embodiments of the present application, in that regard such weaving patterns are considered, in which a sheet of warp threads for a ground pattern stays constantly submerged in reed gaps, even if these warp threads are moved perpendicular to the weft direction for shedding and also during the beat-up motion of the reed.

The above object is achieved by embodiments of a reed and of a weaving machine as set forth herein.

The reed comprises reed blades or dents, which are aligned as a row through combination of their lower ends in a reed band in a longitudinal direction of the reed in such a way that the upper ends of the reed blades form one-sided upwardly open reed gaps. According to an embodiment of the invention, the reed has several groups of reed blades, whereby each reed blade of a first group of reed blades comprises, on its upper end, a guide-in or insertion bevel or lead-in slope member pointing in the longitudinal direction of the reed. This insertion bevel or lead-in slope member is configured in such a way that it at least partially covers the upwardly facing opening of a neighboring reed gap. Furthermore a second group of reed blades is present, which comprise no such insertion bevels. Through the inventive insertion bevel, the immersion or submerging of effect threads into the desired reed gap is ensured, while an unintentional immersion into a neighboring reed gap is prevented.

In an advantageous embodiment, the insertion bevel of the reed blades of the first group pointing in the longitudinal direction of the reed is configured or embodied in such a way that the upwardly facing opening of one or more neighboring open reed gaps and the upper end of one or more neighboring reed blades which belong to the first group are covered at least partially by the insertion bevel. Thereby it is also prevented that the effect threads get stuck on the upper ends of the neighboring reed blades.

In a particularly advantageous embodiment, the insertion bevel of the first group of reed blades is embodied as a pointedly or sharply tapered tongue-like extension of a reed blade, which is angled in the longitudinal direction of the reed opposite the remaining reed blade. This form or shape is easy to manufacture and guarantees the desired function.

In the use of effect threads that are significantly coarser than the warp threads of the ground pattern, it is advantageous that the reed gaps that are bounded by a reed blade with insertion bevel, and that are not covered by an insertion bevel, have a greater width in the longitudinal direction of the reed than the reed gaps that are covered by an insertion bevel. Thus, a submerging of the coarser effect threads into the reed gaps provided therefor is facilitated without too greatly impairing the drawing-in of ground warp threads into the reed.

For the same reason it can be advantageous to provide a greater thickness for the reed blades with insertion bevel in the longitudinal direction of the reed than the reed blades without insertion bevel.

To get more freedom in the patterning of the woven fabric with additional pattern effects, it is applicable or sensible that one or more reed blades without insertion bevel are provided between each two reed blades with an insertion bevel. Whereby it is particularly advantageous when the groups of reed blades with and without insertion bevel are aligned in a row in the longitudinal direction of the reed in such a way that a pattern repeat is formed of the various reed blades and the associated reed gaps, which is repeated over the width of the reed. Thereby regular patterns can be produced, in which also areas with and without additional pattern effects can alternate.

An inventive embodiment of a weaving machine is equipped with shedding elements, by the vertical movement of which a shed bounded by warp threads is formed. Furthermore, devices for the insertion of a weft thread into the shed in a weft direction are present, as well as a reed device for the beating-up of the weft thread against a fabric edge by means of a beat-up motion, which has two end positions. For the formation of the additional pattern effect, guide means for effect threads are provided, as well as a device for slidingly moving the guide means in the weft direction, as well as a device for the vertical movement of the guide means. According to an embodiment of the invention, a reed with two groups of reed blades is provided in the manner described above. This reed is mounted on the reed device in such a way that the warp threads can be drawn into reed gaps and that the effect threads can submerge into and emerge out of those upwardly open reed gaps that are not covered by insertion bevels on reed blades.

In a particularly advantageous embodiment of the inventive weaving machine, the guide means are movable in a plane that is arranged between the shedding elements and the end position of the beat-up motion that lies closer to the shedding elements. In the use of typical heald frames as shedding elements, the guide means thus lie between reed and heald frames. In that regard, the guide means can be embodied for example as needles, which are slidably arranged together in common in a sliding displacement device at the front side of an additional heald frame in the weft direction, whereby the vertical movement of these guide means is derived from the vertical movement of the additional heald frame. In this embodiment it is of course conceivable, to move several groups of guide means on respectively one sliding displacement device together in common or opposite one another. This is made possible, for example, by the use of separate sliding displacement drives for each of these groups. There can also be several groups of guide means attached to different heald frames.

BRIEF DESRCIPTION OF THE DRAWINGS

In the following, advantageous embodiments of the invention are explained in detail with aid of the Figures.

Figure 1:
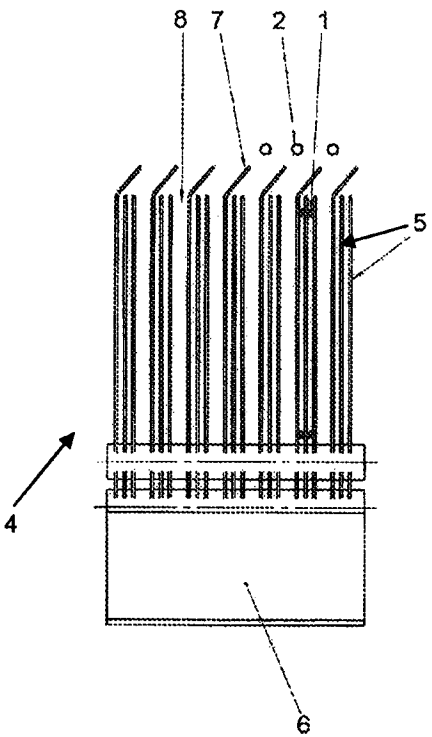
Figure 3:
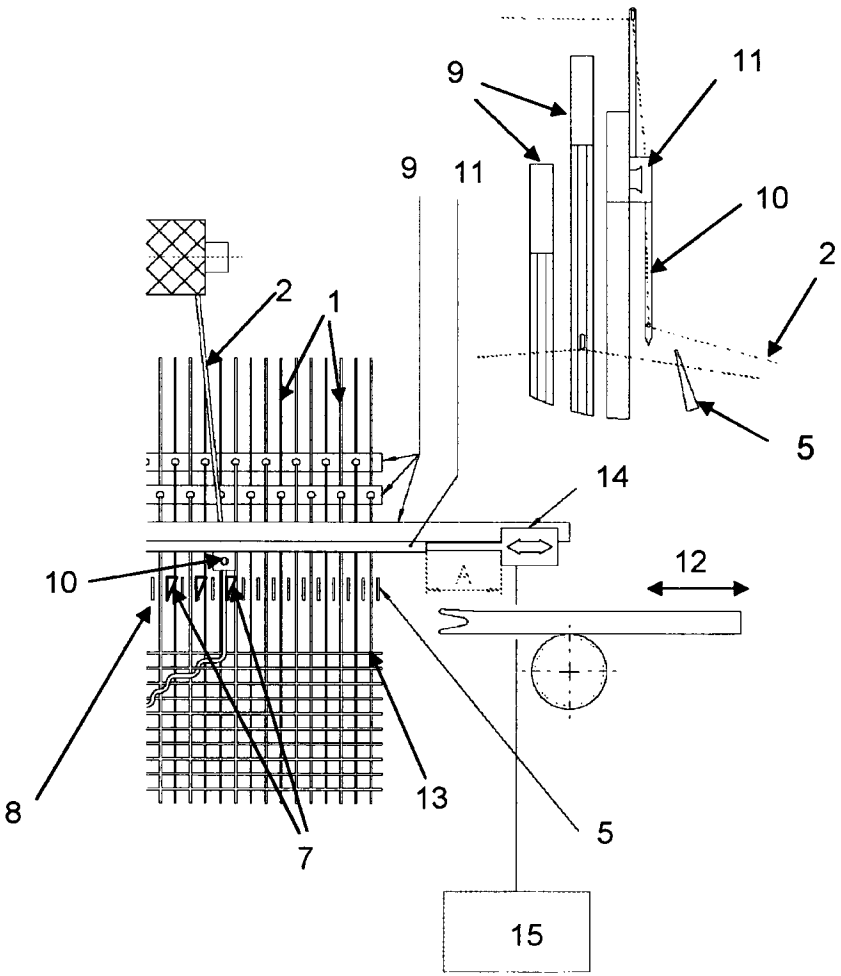

FIG. 1 Embodiment of an inventive reed for a weaving machine with insertion bevels in a view in the warp direction FIG. 2 Embodiment according to FIG. 1 on a weaving machine in a view in the weft direction FIG. 3 Weaving machine with inventive reed in a top plan View

DETAILED DESCRIPTION OF EXAMPLE EMBODIMENTS OF THE INVENTION

FIG. 1 shows a reed 4 with reed blades or dents 5, which are combined together at their lower end in a reed base or reed band 6. The manner in which such a reed band 6 is designed or constructed is known to a person skilled in the art and thus does not need to be explained any further in detail. The example embodiment shows an embodiment with a U-shaped profile and two spiral coil springs, in the windings of which the reed blades 5 are inserted. The upper end of the reed blades 5 is left free so that upwardly open reed gaps 8 are formed. Warp threads 1 are drawn into these reed gaps 8. Some of them are located in the upper shed, i.e. at the upper end of the reed blades 5, while others lie in the lower shed near the reed band 6. In the present example these are each respectively drawn into the same reed gap 8. Moreover, effect threads 2 are shown, which in FIG. 1 are located above the warp threads 1 and above the upper ends of the reed blades 5. To facilitate a submerging of the effect threads 2 into the respective reed gaps 8, according to embodiments of the invention, effect thread guide elements or guide-in slope members or insertion bevels 7 are provided on the upper ends of the main reed blade bodies of certain reed blades 5. These insertion bevels 7 face and protrude from the reed blade bodies in the longitudinal direction of the reed 4, whereby, in the installation in the weaving machine, this longitudinal direction coincides with the weft direction 12 thereof. Through this shaping of reed blades 5, at least the opening of a neighboring reed gap 8 is more or less covered. In the example embodiment of FIG. 1, in fact several openings of reed gaps 8 and the upper ends of the neighboring reed blades 5 without insertion bevel 7 are covered.

Two groups of reed blades 5 are to be recognized, of which the one comprises insertion bevels 7 according to the invention, while the others are embodied or configured without insertion bevels 7 that face in the longitudinal direction of the reed. In FIG. 1 it can also be recognized, that the reed gaps 8, into which an effect thread 2 is guided upon submersion, have wider openings in the longitudinal direction of the reed 4 than the reed gaps 8 into which only warp threads 1 are drawn. This is the basis of a further embodiment, which is especially suitable for the processing of different thicknesses of effect threads 2 and warp threads 1. The direction in which the insertion bevels 7 face is the longitudinal direction of the reed 4 according to the invention. This means that an effect thread 2 that approaches from the top to the insertion bevel 7 is guided in the longitudinal direction of the reed 4 toward the opening of the adjacent reed gap 8. Other than illustrated in FIG. 1, it is also conceivable that the insertion bevels 7 of the reed blades of the second group point in directions opposite one another in the longitudinal direction, if this is useful or sensible for the relevant weaving pattern and the type of effect threads 2. In a particularly favorable embodiment, the insertion bevels 7 are formed or embodied as extensions of the reed blades 5, which are angled in the longitudinal direction by a predetermined angle during the production of the reed 4. Instead of an abrupt transition, of course in principle also a rounded or otherwise configured transition between reed blade 5 and insertion bevel 7 can be provided.

FIG. 2 shows a view of the embodiment of the inventive reed 4 according to FIG. 1 on a weaving machine, with a view direction in the longitudinal direction of the reed 4, i.e. in the weft direction 12 of the weaving machine. Here it can be seen that one or more effect threads 2 are guided by one or more guide means 10 arranged side by side in the weft direction 12, which in the present example comprise the form of a needle with an eye at the lower end. To form a binding point with the weft thread 3, the respective guide means 10 with the effect thread 2 is brought into the lower shed before the weft insertion, so that during the weft insertion the effect thread 2 comes to rest parallel to the lower sheet of warp threads 1 and thereby is crossed-over by the weft thread 3. In addition, the effect thread 2 submerges into a reed gap 8, which is formed by reed blades 5 neighboring one another. In order that the submerging is facilitated, at least one of the two neighboring reed blades 5 at its upper end comprises the insertion bevel 7. In the present example it can be recognized from FIG. 2, that the insertion bevel 7 is constructed or embodied as a tongue-like projection of the reed blade 5 that tapers to a point. Therefore, additional contours that face in the warp direction can also be present on the insertion bevel 7, that is to say that these contours can be angled or bent in the warp direction relative to the vertical longitudinal extension of the reed blades 5. Such contours facing in the warp direction are of course conceivable also on the second group of reed blades 5, which comprise no insertion bevel 7 facing in the longitudinal direction of the reed 4.

After the insertion of the weft thread 3 into the shed, it is beat-up against the fabric edge by a beat-up motion of the reed 4. During this, a change of the warp threads 1 from the upper to the lower shed can also occur, depending on what is prescribed by the weaving pattern of the intended woven fabric. In the present example, the change of the warp threads 1 is carried out by vertically moving shedding elements 9. For example, these can be heald frames with heddles or also Jacquard-heddles, which are each driven in a pattern dependent manner by a shedding machine that is known per se and is not shown. Now, the effect thread 2 can also be raised with the guide means 10, until it emerges out of the reed gap 8 above the warp threads 1, and the guide means 10 is slidingly displaced by a predetermined amount in the weft direction 12 of the weaving machine, before the effect thread 2 submerges into a different reed gap 8 to form a further interlacing point with a weft thread 3 that is subsequently to be inserted.

FIG. 3 shows a weaving machine with inventive reed in a top plan view. Only a partial view with one single effect thread is shown. Also in FIG. 3, a further cut-out section of the weaving machine is shown with a view direction in the weft direction, which includes further details for carrying out the guide means 10 with the associated sliding displacement device 11. In FIG. 3 it can be recognized, that in the present example the weft insertion is carried out by a gripper by means of a gripper bar or a gripper band in the weft direction 12. Naturally the inventive reed 4 is also utilizable in an air jet loom in which a channel-like recess is provided between the upper and lower end of the reed blades 5 in a known manner, which channel-like recess forms a weft insertion channel for weft threads 3 that are to be inserted with an air jet. This has no effect on the embodiment of the inventive insertion bevel 7.

In FIG. 3 it can also be recognized that the warp threads 1 are guided in groups by two shedding elements 9. Further it can be recognized that the guide means 10 for the effect thread 2 is arranged on the front side of an additional shedding element 9. There it is guided by a sliding displacement device 11—e.g. a profile steel on a prism guide. Also, of course, several guide means 10 can be arranged on the sliding displacement device, which guide means are moved parallel in the weft direction 12. The drive of the sliding displacement device is achieved via a sliding displacement drive 14, which is connected with a control device 15 of the weaving machine. Thereby a sliding displacement path or distance A and the vertical movements of the shedding elements 9 as well as the guide means 10 associated or connected therewith can be prescribed in a pattern dependent manner by means of an interlacing pattern draft and via a programming of the control device 15 derived therefrom. Of course, other types of reeds 4 with upwardly open reed gaps 8 are also usable on such a weaving machine. The processing of coarse effect threads 2, however, is significantly improved by the use of a reed 4 with the inventive insertion bevels 7 that face in the longitudinal direction of the reed 4.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims. The abstract of the disclosure does not define or limit the claimed invention, but rather merely abstracts certain features disclosed in the application.

REFERENCE CHARACTERS

1 warp threads
2 effect thread
3 weft thread
4 reed
5 reed blade or dent
6 reed band
7 guide-in or insertion bevel
8 reed gap
9 shedding element
10 guide means
11 sliding displacement device
12 weft direction
13 fabric edge
14 sliding displacement drive
15 control device

The invention claimed is:

1. Reed (4) for a weaving machine with reed blades (5), that are aligned in a row in a longitudinal direction of the reed (4) by combination of their lower ends in a reed band (6) in such a manner that the upper ends of the reed blades (5) form one-sided upwardly open reed gaps (8), characterized in that several groups of reed blades (5) are present, whereby each reed blade (5) of a first group has on its upper end an insertion bevel (7) that faces in the longitudinal direction of the reed (4), and that is configured in such a manner that it at least partially covers the upwardly facing opening of a neighboring reed gap (8), and in that a second group of reed blades (5) which comprise no such insertion bevels (7) is present.

2. Reed (4) according to claim 1, characterized in that the upwardly facing opening of one or more open reed gaps (8) and the upper end of one or more reed blades (5) that belong to the second group are at least partially covered by the insertion bevel (7), which faces in the longitudinal direction of the reed (4), of a neighboring reed blade (5) that belongs to the first group.

3. A weaving reed for a weaving machine, comprising:

a reed base extending in a longitudinal direction, and plural reed blades that comprise reed blade bodies respectively having first ends secured to said reed base and opposite second ends protruding away from said reed base in a blade direction;

wherein:

said reed blade bodies are arranged in a row and successively spaced from one another with respective successive reed gaps formed therebetween in said longitudinal direction along said reed base, said reed gaps are open at gap openings at said second ends of said reed blade bodies, said reed blades include first reed blades and second reed blades, said first reed blades further comprise thread guide elements that project in said longitudinal direction away from said second ends of said reed blade bodies of said first reed blades so as to at least partially extend over said gap openings of said reed gaps adjacent on at least one side of said first reed blades, and said second reed blades do not include such said thread guide elements.

4. The weaving reed according to claim 3, wherein said thread guide elements are sloping thread guide elements that each respectively have a sloping guide surface which slopes obliquely away from said second ends of said reed blade bodies in said longitudinal direction and in said blade direction away from said reed base.

5. The weaving reed according to claim 4, wherein said sloping guide surface has a planar triangular shape.

6. The weaving reed according to claim 4, wherein said sloping thread guide elements are pointed tapered extension tongues which extend at an angle from said second ends of said reed blade bodies of said first reed blades.

7. The weaving reed according to claim 3, wherein said thread guide elements are respectively bent at an angle from said reed blade bodies of said first reed blades at abrupt transitions at said second ends.

8. The weaving reed according to claim 3, wherein said thread guide elements transition to said reed blade bodies of said first reed blades respectively with a smooth rounded transition at said second ends.

9. The weaving reed according to claim 3, wherein said thread guide elements further project away from said second ends of said reed blade bodies of said first reed blades in a warp direction that is orthogonal to said longitudinal direction and said blade direction.

10. The weaving reed according to claim 3, wherein all of said thread guide elements project in a same single orientation in said longitudinal direction.

11. The weaving reed according to claim 3, wherein some of said thread guide elements project in a first orientation and others of said thread guide elements project in an opposite second orientation in said longitudinal direction.

12. The weaving reed according to claim 3, wherein said second reed blades terminate and are unsupported at said second ends of said reed blade bodies of said second reed blades.

13. The weaving reed according to claim 3, wherein said reed blades have a weft insertion channel formed extending along said longitudinal direction for an air jet weft insertion on an air jet loom.

14. The weaving reed according to claim 3, wherein said thread guide elements each respectively extend in said longitudinal direction over at least one said gap opening of at least one said reed gap and over said second end of at least one said second reed blade.

15. The weaving reed according to claim 3, wherein ones of said reed gaps adjacent to said first reed blades on a side thereof opposite said side to which said thread guide elements project do not have said thread guide elements extending over said gap openings thereof, and have a greater width in said longitudinal direction than said reed gaps over which said thread guide elements extend.

16. The weaving reed according to claim 3, wherein said first reed blades have a greater thickness than said second reed blades.

17. The weaving reed according to claim 3, wherein at least one of said second reed blades is respectively arranged between each successive two of said first reed blades.

18. The weaving reed according to claim 3, wherein at least one of said first reed blades and at least one of said second reed blades are arranged in succession in a pattern in a grouping of said reed blades, and said grouping is repeated successively along said reed to form a pattern repeat in said longitudinal direction.

19. A weaving machine comprising the weaving reed according to claim 3, and further comprising:

shedding elements configured and arranged to open and close successive sheds bounded by warp threads extending in a warp direction, a weft insertion arrangement configured and arranged to insert successive weft threads into said sheds in a weft direction, a beating arrangement that carries said weaving reed with said longitudinal direction thereof extending along said weft direction, and that is configured and arranged to beat said weaving reed between a beat-up position and a retracted position, wherein said reed in said beat-up position beats a respective one of said weft threads against a fabric edge being formed during a weaving operation, and an effect thread guide arrangement configured and arranged to guide and move effect threads in said weft direction and in said blade direction, wherein said reed is arranged so that said warp threads can extend in said warp direction through said reed gaps of said reed, and so that said effect thread guide arrangement can move said effect threads into and out of said reed gaps through said gap openings that do not have said thread guide elements of said first reed blades extending thereover.

20. The weaving machine according to claim 19, wherein said effect thread guide arrangement is movable in a plane located between said retracted position of said weaving reed and a location of said shedding elements.

21. A weaving reed comprising:

a reed base, reed blades that are connected at bottom ends thereof to said reed base, and that protrude upwardly from said reed base, and that are spaced apart from one another with reed gaps therebetween along said reed base, and thread guide elements provided at upper ends of only some of said reed blades, wherein each said thread guide element respectively includes a thread guide surface extending obliquely upwardly and laterally over a respective said reed gap adjacent to one side of a respective said reed blade on which said thread guide element is provided.

* * * * *